United States Patent [19]

Furuya

[11] Patent Number: 4,933,718

[45] Date of Patent: Jun. 12, 1990

[54] ELECTROSTATOGRAPHIC PRINTING APPARATUS WITH IMAGING MEMBER INSTALLATION DETECTION

[75] Inventor: Ken Furuya, Hongo Ebina, Japan

[73] Assignee: Xerox Corporation, Stamford, Conn.

[21] Appl. No.: 919,727

[22] Filed: Oct. 16, 1986

[30] Foreign Application Priority Data

Nov. 25, 1985 [JP] Japan ..... 60-181097

[51] Int. Cl.[5] ..... G03G 15/00

[52] U.S. Cl. ..... 355/203; 355/206

[58] Field of Search ..... 355/14 C, 14 CU, 35 H, 355/3 DR, 14 R, 14 SH, 14 D, 210, 203, 205, 206, 209

[56] References Cited

U.S. PATENT DOCUMENTS 3,872,282 3/1975 Long ..... 355/14 CU
3,880,518 4/1975 Chatfield ..... 355/16
4,477,178 10/1984 Furuichi et al. ..... 355/14 C
4,500,195 2/1985 Hosono ..... 355/3 DR
4,559,519 12/1985 Matsumoto et al. ..... 355/14 C
4,605,299 8/1986 Mochimaru ..... 355/3 DR
4,666,290 5/1987 Yoshiura ..... 355/14 D
4,803,521 2/1989 Honda ..... 355/210

*Primary Examiner*—R. L. Moses
*Assistant Examiner*—Ed Pipala

[57] ABSTRACT

An electrostatographic printing apparatus has a main frame and a unit including an imaging member, the unit being removably mounted to the main frame at a predetermined position for cooperative association with the main frame in producing prints, the unit includes detectable element, and the main frame includes a detector for detecting the detectable element when the unit is in its predetermined position and provides an indication when the detector does not detect the detectable element.

10 Claims, 3 Drawing Sheets

ELECTROSTATOGRAPHIC PRINTING APPARATUS WITH IMAGING MEMBER INSTALLATION DETECTION

BACKGROUND OF THE INVENTION

The present invention relates to electrostatographic printing apparatus and more particularly to an apparatus for detecting whether a removable imaging member is installed in the printing apparatus in a predetermined operative position.

In an electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

Many commercial applications of the above employ a modular concept for the various processing stations. For example, the imaging member, developer assembly and cleaner assembly may be combined in a single unit or cartridge which has a limited life at the end of which it may be discarded and replaced with a new unit or cartridge. Alternatively, a charging device may be added to the unit or the unit may contain any of the developer, cleaner, and imaging member.

PRIOR ART

U.S. Pat. No. 3,985,436 (Tanaka et al.) describes a copying apparatus in which an imaging member, developing device and cleaner may be incorporated in a casing as one unit to be releasably inserted into the main apparatus housing for cooperative association therewith in making copies.

U.S. Pat. No. 3,689,146 (Ito et al.) discloses a similar device wherein the developer transfer, cleaning and fixing devices are on a single support which is movable into and out of operative position adjacent a drum surface when the drum is repaired or replaced.

U.S. Pat. No. 3,966,316 (Pfeifer et al.) discloses photosensitive drum and cleaning unit mounted in a plastic casing of a module which can be inserted into the main portion of the housing.

Difficulties may be encountered in such machine concepts if the processing unit containing the imaging member such as a photosensitive member is not properly positioned in the main frame of the apparatus when placed in the apparatus and an operator attempts to make a print not appreciating or having any indication of the misplacement. For example, the imaging member can be physically damaged if printing or copying is made with the imaging member is improperly positioned. Furthermore, the photosensitive unit has a charging corotron and the copier has a high voltage generator of the charge tracking type, the improper positioning of the photosensitive unit may cause the charging corotron to malfunction, reducing the corotron current. This may result in an extremely high voltage to other corotrons for transfer, erase, and detack, causing leakage and damaging the photosensitive body or shortening the life of the high voltage generator or the corotron wires.

SUMMARY OF THE INVENTION

In a principle aspect of the present invention an apparatus is provided for detecting when a processing unit containing an image bearing member is properly positioned in the main machine frame and for providing an indication when the processing unit is not properly set in the predetermined position and corrective action should be taken.

In a further principle aspect of the present invention, the apparatus is inhibited from functioning, printing, when the processing unit is detected to be not properly positioned in its predetermined position.

In a further aspect of the present invention, a electrostatographic processing unit including an imaging member which is removably mountable to the main frame of a printing apparatus has means detectable by detecting means in the main frame when the processing unit is properly set in its predetermined operating position and the main frame has detecting means for detecting the detectable means when the processing unit is in its predetermined position and means for providing an indication when the detecting means does not detect the detectable means.

In a further aspect of the present invention, the indicator means provides a visual indication displaying a warning on the apparatus control panel.

In a further aspect of the present invention, the detectable means comprises a projection on the imaging member and detecting means comprises a connector, switch or photointerruptor.

DESCRIPTION OF THE PREFERRED EMBODIMENTS

According to the present invention an installation checker is provided for a process unit which is removably mounted into the main frame of a printing apparatus which includes a detectable means on the process unit and a detecting means on the main frame for detecting the detectable means when the process unit is mounted in its proper predetermined position for cooperative association with the main frame in producing prints and means for providing an indication when the detecting means does not detect the detectable means to inform a user to take corrective action to properly position the process unit in its predetermined position.

The installation checker may include a projection on the process unit which, typically may contain a photosensitive imaging member, and a detector in the main frame for sensing the projection when it is properly positioned at a predetermined position in the main frame and a display on the control panel warning when the detector does not sense the projection.

Figure 1:
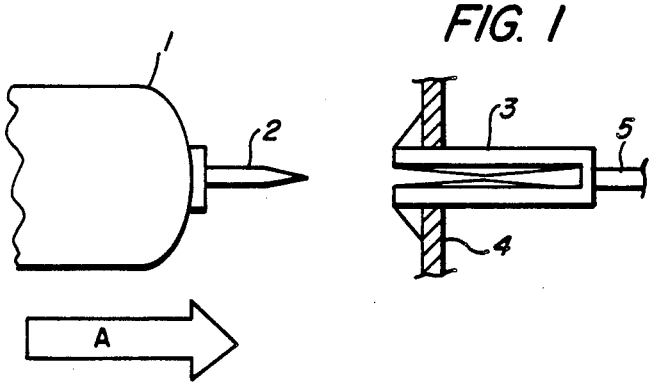
FIG. 1 is a partial side view of a processing unit containing a photosensitive member and a copier frame.
Figure 2:
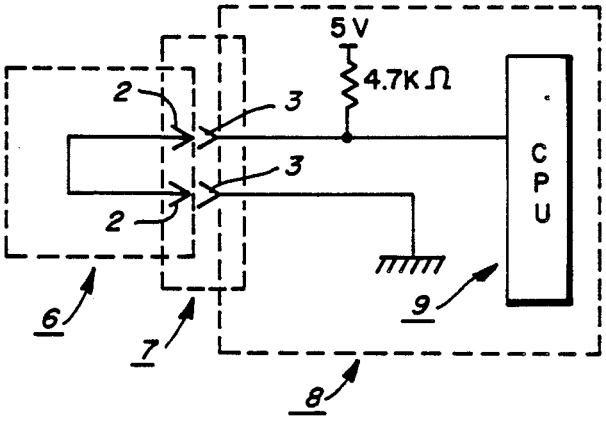
FIG. 2 is a schematic circuit diagram of the processing unit and the copier frame.
Figure 3:
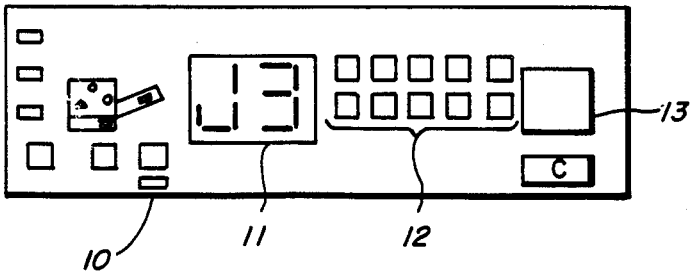
FIG. 3 is a plan view of the control panel of a copier.

Referring now to FIGS. 1 and 2, two male connectors 2 are integrally formed with an end of a process unit 1 containing a photosensitive member. Two female connectors 3 are secured to a main copier frame 4 for receiving the male connectors 1. A cord 5 is electrically connected to the female connectors 3. The two male connectors 2 are electrically connected inside the process unit 1. When the process unit 1 is set into the copier frame 4 correctly in the direction of an arrow A, the electrical circuit of FIG. 2 is established. A unit circuit 6 is connectable with a machine circuit 8 including a Central Processor Unit (CPU) 9, through a drawer connector 7.

As is apparent from the figures, when the process unit 1 is set into the copier frames 4 correctly to connect the male connectors 2 with the female connectors 3, the voltage put into the CPU 9 is zero (low level). Conversely, when the male and female connectors 2 and 3 are not connected correctly, the voltage put into the CPU 9 is not at the low level but approximately 5 volts (high level).

When the CPU 9 receives the high level, a message "J3" is displayed in the No. of Copies window 11 on the control panel 10 and the receipt of any job started by pressing a Start key 13 is inhibited. On the other hand, when the voltage put into the CPU 9 is at the low level, the number of copies set is displayed in the No. of Copies window 11 and the receipt of a job started by pressing the Start key 13 is accepted. In this illustrated embodiment, a numerical pad 12 is provided between the No. of Copies window 11 and the Start key 13 on the control panel 10.

Figure 4:
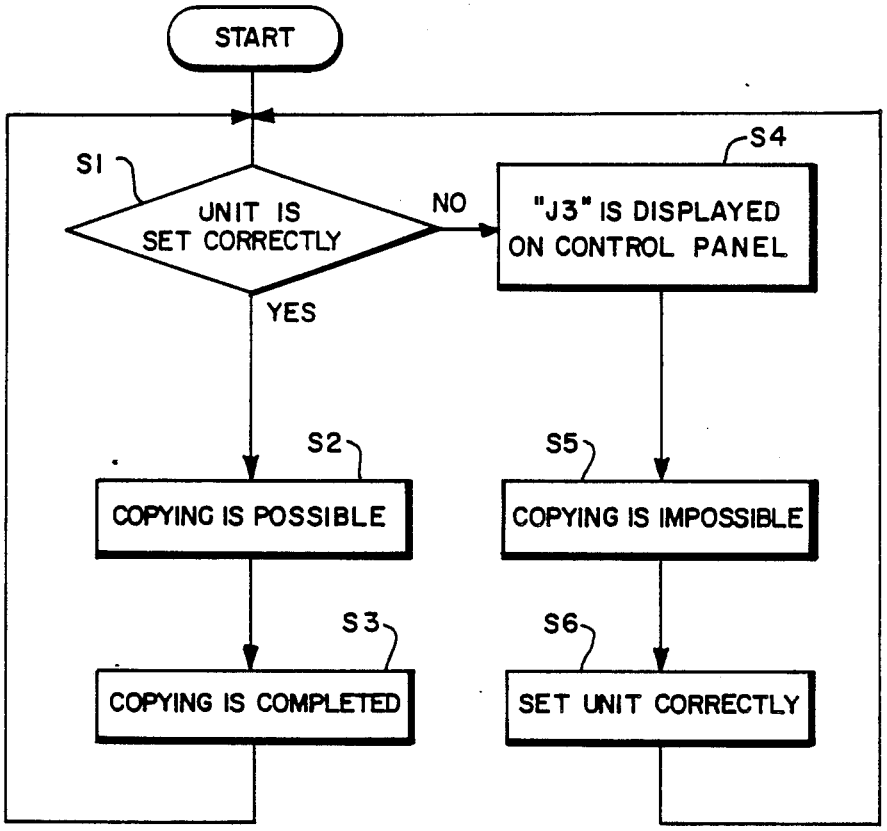
FIG. 4 is a flow chart showing the function of a microcomputer.

FIG. 4 illustrates the function of CPU 9. The CPU 9 first checks the input voltage at high or low level to determined whether the process unit 1 is set in the copier frame 4 correctly or not (Step 1). If the unit is set correctly, it proceeds to Step 2. In Step 2, it makes the machine ready for copying when the Start key 13 is pressed. When copying is completed (Step 3), it returns to Step 1 to check whether the unit 1 is set correctly or not.

When the CPU 9 determines in Step 1 that the unit 1 is not properly positioned in its predetermined position, it displays a warning "J3" in the No. of Copies window 11 (Step 4). Then, it disables the machine even if the Start key 13 is pressed (Step 5). When the operator resets the unit 1 in Step 6, it returns to Step 1 to make the above decision.

As has been described above, according to the invention, an improper setting or positioning of the process unit 1 into the copier frame 4 is displayed in the No. of Copies window so that the operator may immediately know the incorrect condition and take a corrective action. Even if the operator overlooked this condition and pressed the Start key 13, the copying operation has been inhibited: neither the photosensitive member is rotated nor a high voltage applied to the corotrons, thus preventing damage to the photosensitive member and reduction in the life of the high voltage generator.

Figure 5A:
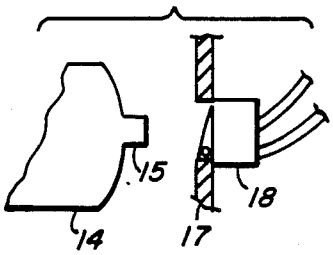
FIGS. 5 and 6 are side views and schematic circuit diagrams for alternative embodiments.
Figure 5B:
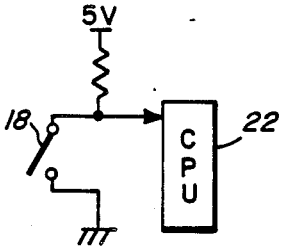

In FIG. 5*a* there is shown a second embodiment of the invention wherein an actuator 15 is secured to an end of a process unit 14. A microswitch 18 is mounted on the copier frame 17 at a position to which the actuator 15 turns on the microswitch 18. The schematic circuit diagram is shown in FIG. 5*b*. When the microswitch 18 is turned on, the voltage put into the CPU 22 is at the low level, while when the unit 18 is not set correctly the input voltage is at the high level. The function of CPU 22 is the same as that of the first embodiment, and therefore its description is omitted.

Figure 6A:
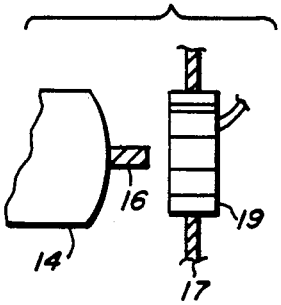
Figure 6B:
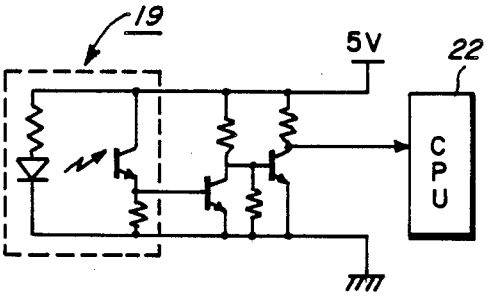

FIGS. 6*a* and 6*b* illustrates a further embodiment of the invention. When an opaque actuator 16 secured to an end of the process unit 14 and enters a phtointerruptor 19 to block the light path, the voltage put into the CPU 22 is at the low level. In the opposite case, the input voltage is at the high level.

Figure 7:
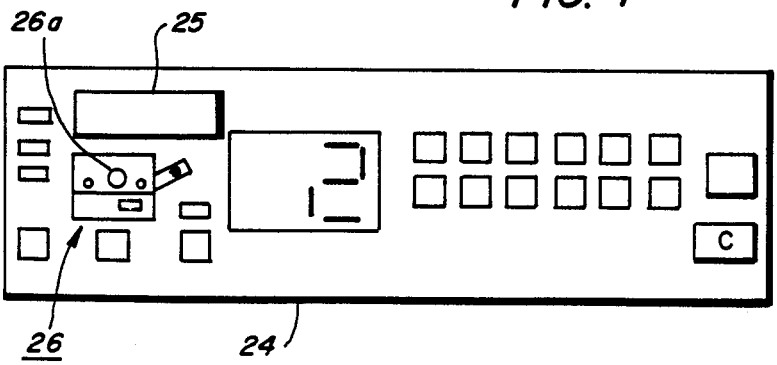
FIG. 7 is a plan view of another control panel for a copier.

FIG. 7 shows another embodiment of the control panel 24. When the process unit is not set correctly into the copier frame, a message such as "PLEASE SET DRUM" is displayed in a window 25 and/or the corresponding location 26*c* is flashed in a location display 26.

According to the invention when the process unit 1 is not set correctly in a predetermined position within the main frame of the copier, a warning is displayed on the control panel so that the operator may easily know the incorrect condition and take a corrective action. In such a case, the copying job is inhibited so neither the photosensitive member is damaged nor the life of a high voltage generator is shortened. If the process unit is initially positioned correctly with the main frame, routine copying is provided.

While the invention has been described with reference to specific embodiments, it will be apparent to those skilled in the art that many alternatives modifications and variations may be made. For example, while the invention has been described with reference to a processing unit containing an imaging member such as a photosensitive drum for a copier, it will be appreciated that it has equal application to electronic printers. It will also be appreciated that the photosensitive drum may itself constitute the process unit or be combined with other functional assemblies such as the cleaner, developer and charging device into a single process unit. Furthermore, while a visual indication that the process unit is incorrectly set in its predetermined position is described, the indication could equally well be acoustical. Accordingly, it is intended to embrace all such alternatives and modifications that may fall within the spirit and scope of the appended claims.

The disclosure of the patents referred to herein are hereby specifically and totally incorporated herein by reference.

What is claimed is:

1. An electrostatographic printing apparatus comprising a main frame and a unit including an imaging member said unit being removably mounted to said main frame at a predetermined position for cooperative association with said main frame in producing prints, said unit including detectable means, said main frame including detecting means for detecting said detectable means when said unit is in its predetermined position and means for providing an indication when said detecting means does not detect said detectable means.

2. The apparatus of claim 1, wherein said means for providing an indication comprises a visual indicator.

3. The apparatus of claim 2, wherein said visual indicator comprises means for displaying a warning on the apparatus control panel.

4. The apparatus of claim 1, wherein said unit comprises a rotatably mounted photosensitive drum.

5. The apparatus of claim 1, wherein said detectable means comprises a projection on said imaging member and said detecting means comprises a connector, switch or photointerruptor.

6. The apparatus of claim 1, further including means for inhibiting printing when said detecting means does not detect said detectable means.

7. The apparatus of claim 6, wherein said detectable means comprises a projection on said imaging member and said detecting means comprises a connector, switch or photointerruptor.

8. An electrostatographic processing unit including an imaging member, said unit being removably mountable to the main frame of a printing apparatus and including means detectable by detecting means in said main frame to provide an indication when said unit is in a predetermined position in said main frame for cooperative association therewith in producing prints.

9. The apparatus of claim 8, wherein said detectable means comprises a projection on said imaging member.

10. The apparatus of claim 8, wherein said imaging member comprises a rotatably mounted photosensitive drum.

* * * * *